United States Patent [19]

Komamura et al.

[11] Patent Number: 4,847,188

[45] Date of Patent: Jul. 11, 1989

[54] THERMALLY DEVELOPABLE LIGHT-SENSITIVE MATERIAL

[75] Inventors: Tawara Komamura; Hidenobu Ohya, both of Hino, Japan

[73] Assignee: Konica Corporation, Tokyo, Japan

[21] Appl. No.: 150,777

[22] Filed: Feb. 1, 1988

[30] Foreign Application Priority Data

Feb. 5, 1987 [JP] Japan ..... 62-25381

[51] Int. Cl.[4] ..... G03C 5/54; G03C 7/32

[52] U.S. Cl. ..... 430/545; 430/203; 430/222; 430/223; 430/226; 430/351; 430/543; 430/548; 430/553; 430/555; 430/557; 430/558; 430/559; 430/224

[58] Field of Search ..... 430/203, 222, 223, 224, 430/226, 351, 545, 559, 543, 548, 553, 555, 557, 558

[56] References Cited

U.S. PATENT DOCUMENTS

| | | | |
|---|---|---|---|
| 3,404,017 | 10/1968 | Muller-Bardoff et al. | 430/559 |
| 3,761,270 | 9/1973 | de Mauraic et al. | 430/551 |
| 4,507,380 | 3/1985 | Naito et al. | 430/203 |
| 4,656,124 | 4/1987 | Komamura | 430/203 |
| 4,766,056 | 8/1988 | Takahashi et al. | 430/203 |

*Primary Examiner*—Richard L. Schilling
*Attorney, Agent, or Firm*—Jordan B. Bierman

[57] ABSTRACT

A thermally developable light-sensitive material having at least a light-sensitive silver halide, a reducing agent, a binder and a dye-providing material on a support is disclosed. The dye-providing material is a compound that releases or forms a diffusible dye as a function of development and which has a group capable of reacting with the nucleophilic agent.

19 Claims, No Drawings

THERMALLY DEVELOPABLE LIGHT-SENSITIVE MATERIAL

BACKGROUND OF THE INVENTION

The present invention relates to a thermally developable light-sensitive material capable of forming a dye image by a thermal dry process. In particular, the present invention relates to a thermally developable light-sensitive material capable of forming a color image by diffusion transfer of a dye.

Thermally developable light-sensitive materials which provide image in a simple and quick way through development that is conducted by a thermal dry process have been known and these materials as well as methods for forming image thereon are described in many references such as "Shashin Kogaku no Kiso (Fundamentals of Photographic Engineering), pp. 553-555, Coronasha, 1979, and Research Disclosure (RD-17029), pp. 9–15, June, 1978.

Active efforts have recently been made to design thermally developable color light-sensitive materials which produce color image using a variety of dye-providing materials. Among the processes proposed so far, one that produce color image by transferring the diffusible dye that has been released or formed as a result of thermal development is reputed for the many advantages it offers such as image stability and sharpness, as well as simplicity and rapidity of processing. Thermally developable color light-sensitive materials employing this transfer process and methods for forming image by this process are described in the specifications of many patents such as Japanese Patent Application (OPI) Nos. 12431/1984 (the term OPI as used hereinafter means an unexamined published Japanese patent application), 159159/1984, 181345/1984, 229556/1984, 2950/1985, 1986, 61158/1986, 61157/1986, 180550/1984, 132952/1986, 139842/1986, and U.S. Pat. Nos. 4,595,652, 4,590,154 and 4,584,267.

In the thermally developable light-sensitive materials of the type described above, dye-providing materials often diffuse together with the formed or released dye when the latter is subjected to heat diffusion transfer and the diffusing dye-providing materials will subsequently form or release a dye in layers where such a phenomenon should not occur. This can cause color mixing, which is detrimental to the color purity of image and becomes severe when a hot solvent is incorporated in the light-sensitive material with a view to activating thermal development and dye transfer. Similar color mixing can take place when a dye-providing material of the non-transfer type is employed.

In order to prevent this undesirable color mixing, studies have been conducted that are directed to improving the immobility of dye-providing materials. The accomplishments of these studies have been described in the specifications of many patents such as Japanese patent application (OPI) Nos. 159159/1984, 181345/1984, 2950/1985, 57943/1986, 59336/1986, 61157/1986, 61158/1986, 65037/1987, 44738/1987, 129852/1987 and 143049/1987. Polymeric dye-providing materials have particularly high immobility and are preferably used to prevent color mixing. However, the use of such polymeric dye-providing materials has not been a complete solution to the problem of color mixing in cases where a smaller amount of binder or an increased amount of thermal solvent is used with a view to improving developability or transferrability.

SUMMARY OF THE INVENTION

The present invention has been accomplished in order to eliminate the afore-mentioned defects of light-sensitive materials having the conventional dye-providing materials.

An object, therefore, of the present invention is to provide a thermally developable light-sensitive material that presents a high color purity in image by employing a dye-providing material that exhibits great immobility in the light-sensitive material during development.

Another object of the present invention is to provide a thermally developable light-sensitive material that imparts high image density and has improved resistance to fogging.

These objects of the present invention can be attained by a thermally developable light-sensitive material having at least a light-sensitive silver halide, a reducing agent, a binder and a dye-providing material on a support, characterized in that said dye-providing material is a compound which has a group capable of substitution or addition reaction with a nucleophilic agent.

DETAILED DESCRIPTION OF THE INVENTION

The dye-providing material used in the present invention may be of any type that participates in a reductive reaction during development so as to form or release a diffusible dye as a function of this reaction. According to the type of reaction involved, this substance is classified as a negative-acting dye-providing material which works as a positive function of the reaction (i.e., forms a negative dye image when a negative-acting silver halide is used) or as a positive-acting dye-providing material which works as a negative function of the reaction (i.e., forms a positive dye image when a positive-acting silver halide is used). In whichever type, it is preferable that the dye-providing material is composed of a group moiety that is responsible for dye formation or release as a function of development and which is bonded to a nucleophilic agent reactive group moiety either directly or via a divalent linkage. A preferred example of the group that is responsible for dye formation or release as a function of development is the residue of a compound that forms or releases a diffusible dye as a function of development.

An example of the residue of a compound capable of forming a diffusible dye is represented by the following general formula (1):

$$(\text{Coup})_1\text{—X—} \qquad (1)$$

where $(\text{Coup})_1$ is the residue of a compound (coupler) that forms a diffusible dye upon coupling reaction with the oxidized product of reducing agent; and X is a group that is substituted at the active site of the coupler and which is eliminated therefrom upon coupling reaction, said group being bonded to a binder reactive group either directly or via a divalent linkage.

Preferred examples of the coupler residue represented by $(\text{Coup})_1$ in formula (1) are listed below:

(2)

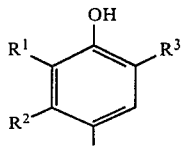

(3)

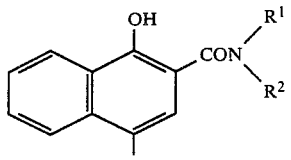

(4)

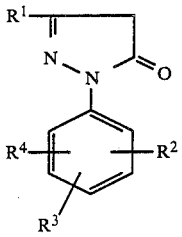

(5)

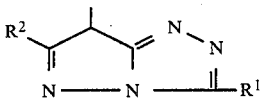

(6)

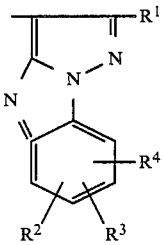

(7)

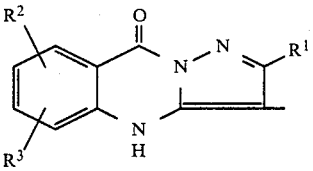

(8)

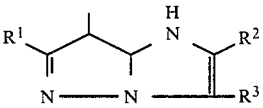

(9)

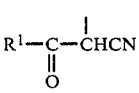

(10)

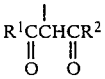

-continued (11)

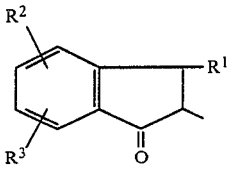

In these formulas (2) to (11), $R^1$, $R^2$, $R^3$ and $R^4$ each independently represents a hydrogen atom, a halogen atom, an alkyl group, a cycloalkyl group, an aryl group, an acyl group, an alkyloxycarbonyl group, an aryloxycarbonyl group, an alkylsulfonyl group, an arylsulfonyl group, a carbamoyl group, a sulfamoyl group, an acyloxy group, an amino group, an alkoxy group, an aryloxy group, a cyano group, an alkyl sulfonyl group, an arylsulfonyl group, a ureido group, an alkylthio group, an arylthio group, a carboxyl group, a sulfo group or a heterocyclic residual group; each of these may be substituted by a hydroxyl group, a carboxyl group, a sulfo group, an alkoxy group, a cyano group, a nitro group, an alkyl group, an aryl group, an aryloxy group, an acyloxy group, an acyl group, a sulfamoyl group, a carbamoyl group, an imido group, a halogen atom, etc.

The substituent group X may be selected from among any known groups that are conventionally used as substituents at the active site of photographic couplers. Preferred examples include:

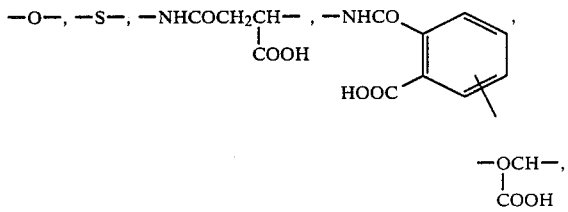

and a divalent nitrogenous heterocyclic group (bonded to the active site of a coupler via a nitrogen atom and preferably having a carbonyl group on the position adjacent to the nitrogen atom bonded to the active site of the coupler).

When the group capable of reacting with a nucleophilic agent is bonded to the substituent group X via a divalent linkage, the following may be used as the divalent linkage:

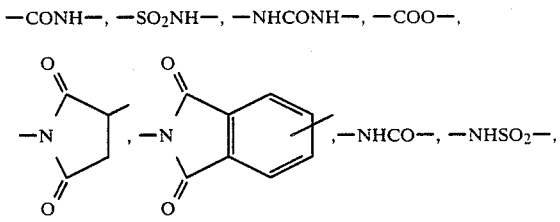

—O—, —S—, —N— (R is a hydrogen atom or an alkyl group),

—CO—, $-(CH_2)_n-$ (n = 1-4), and

-continued

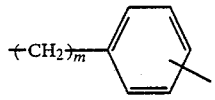

(m = 1-4).

Specific examples of the compound represented by formula (1) are shown in such prior patents as Japanese Patent Application (OPI) Nos. 124339/1984, 181345/1984, 123840/1985, 173448/1985, 179739/1985, 203942/1985, 212762/1985, 222850/1985, 39042/1986, 57943/1986, 59336/1986, 61157/1986, 61158/1986 and 148447/1986.

An example of the compound that releases a diffusible dye may be represented by the following general formula (12):

$$Cp_2-(X)_n-Dye \quad (12)$$

where $Cp_2$ is the residue of a compound (coupler) that reacts with the oxidized product of a reducing agent to release a diffusible dye [this residue being preferably represented by formulas (2)-(11)]; Dye is a diffusible dye residue; X has the same meaning as defined for formula (1); and n is 0 or 1.

Specific examples of the compound represented by formula (12) are shown in such prior patents as Japanese Patent Application (OPI) Nos. 186744/1982, 122596/1982, 160698/1982, 174834/1984, 159159/1984 and 231540/1984.

Another example of the compound capable of releasing a diffusible dye is a reductive dye releasing compound represented by the following general formula (13):

$$Car-NHSO_2-Dye \quad (13)$$

where Car is a reductive substrate (so-called carrier) that is oxidized to release a dye when reducing a light-sensitive silver halide and an optionally employed organic silver salt; and Dye is a diffusible dye residue.

Specific examples of the reductive dye releasing compound are shown in such prior patents as Japanese Patent Application (OPI) Nos. 179840/1982, 116537/1983, 60434/1984, 65839/1984, 71046/1984, 87450/1984, 88730/1984, 123837/1984, 165054/1984 and 165055/1984.

A further example of the compound capable of releasing a diffusible dye is a positive-acting dye-providing material represented by the following general formula (14):

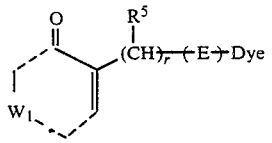

(14)

where $W_1$ is the group of atoms necessary to form a quinone ring (which may have a substituent on the ring); $R^5$ is an alkyl group or a hydrogen atom; E denotes

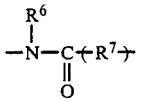

(where $R^6$ is an alkyl group or a hydrogen atom, and $R^7$ is an oxygen atom or

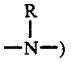

or $-SO_2-$; r is 0 or 1; and Dye has the same meaning as defined for formula (13). Specific examples of this compound are also found in prior patents such as Japanese Patent Application (OPI) Nos. 166954/1984 and 154445/1984.

A still further example of the compound capable of releasing a diffusible dye is a compound that is oxidized to lose its dye releasing capability as typified by a positive-acting dye-providing material having the following general formula (15):

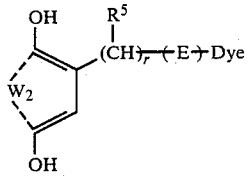

(15)

where $W_2$ is the group of atoms necessary to form a benzene ring (which may have a substituent on the ring); and each of $R_5$, r, E and Dye has the same meaning as defined for formula (14). Specific examples of this compound are found in such prior patents as Japanese Patent Application (OPI) Nos. 124327/1984 and 152440/1984.

Still another example of the compound capable of releasing a diffusible dye is a positive-acting dye-providing material represented by the following general formula (16):

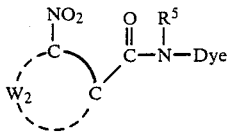

(16)

where $W_2$, $R^5$ and Dye each has the same meaning as defined for formula (15). Specific examples of this compound are shown in prior patents such as Japanese Patent Application (OPI) No. 154445/1984.

The diffusible dye residue signified by Dye in formulas (12) to (16) is hereunder described in greater detail. In order to provide the necessary level of diffusibility, the diffusible dye residue preferably has a molecular weight of 800 and less, more preferably 600 and less. Illustrative dye residues are those of azo, azomethine, anthraquinone, naphthoquinone, styryl, nitro, quinoline, carbonyl and pthalocyanine dyes. The spectral absorption of these dye residues may be temporarily shifted to a shorter wavelength in order to regenerate the desired image color afterward, i.e., during thermal development or transfer. Chelatable dye residues of the type described in Japanese Patent Application (OPI) Nos. 48765/1984 and 124337/1984 are also preferred.

The group capable of reacting with a necleophilic agent is described hereinafter. Any group that reacts with a functional group in a nucleophilic agent, such as an amino group, a hydroxyl group, mercapto group or a carboxyl group, to produce a covalent bond may be used in the present invention. Preferred examples are those which are known as reactive groups present in hardening agents commonly used with photographic materials, and they include an aldehyde group, an active vinyl group, an active ester group, an active halide group, an epoxy group, a diazine group, an aziridine group, an isocyanato group, and a triazine group such as a dichloro- or monochloro-triazine group.

The dye-providing material used in the present invention preferably has a ballast group in order to improve its immobility. In dye-providing materials comprising the residues of diffusible-dye forming compounds represented by formula (1), the ballast group is bonded to the substituent group at the active site either directly or via a divalent linkage; in other types of dye-providing materials, the ballast group is bonded, either directly or via a divalent linkage, to a portion other than the diffusible dye residue to be released.

Any group that has a molecular size and shape that is sufficient to reduce the diffusibility of the dye-providing material may be employed as the ballast group. Preferred examples are organic groups that contain at least 8 carbon atoms, more preferably at least 12 carbon atoms. A polymer residue is a particularly preferred ballast group. In this preferred case, the dye-providing material preferable for use in the present invention is a homopolymer derived from a dye-providing monomer that has a group of the following general formula (17) (one having an ethylenically unsaturated group) substituted for the substituent group at the active site if said dye-providing material comprises the residue of a diffusible dye forming compound as represented by general formula (1) and at a portion other than the diffusible dye residue to be released if said dye-providing material is of other types, and if desired, such a dye-providing monomer may be copolymerized with another monomer to form a dye-providing copolymer, said homopolymer and copolymer preferably having a weight average molecular weight of from 5,000 to 50,000:

$$\text{-}(Y_1)_{l_1}\text{-}(J_1)_{m_1}\text{-}(Y_2)_{l_2}\text{-}(J_2)_{m_2}\text{-}\overset{\overset{R}{|}}{C}{=}CH_2 \qquad (17)$$

where $Y_1$ and $Y_2$ each represents a divalent hydrocarbon group, which may be illustrated by an alkylene group (e.g., methylene, ethylene or propylene), an arylene group (e.g., phenylene) or combinations of alkylene and arylene groups (e.g., methylenephenylene); $J_1$ and $J_2$ each represents a divalent linkage, which may be illustrated by —NHCO—, —CONH—, —COO—, —OCO—, —SCO—, —COS—, —O—, —S—, —SO— and —$SO_2$—; R is an alkyl group (e.g., methyl or ethyl) or a hydrogen atom; $l_1$, $m_1$, $l_2$ and $m_2$ are each 0 or 1.

In a preferred embodiment of the case where the dye-providing material is a copolymer, said copolymer is made up of the above-described dye-providing monomer and a monomer having a group capable of reacting with a nucleophilic agent, or of these monomers in combination with a third monomer. A preferred example of the monomer having a group capable of reacting with a nucleophilic agent is a compound represented by the following general formula (18):

$$Q\text{-}(Y_1)_{l_1}\text{-}(J_1)_{m_1}\text{-}(Y_2)_{l_2}\text{-}(J_2)_{m_2}\text{-}\overset{\overset{R}{|}}{C}{=}CH_2 \qquad (18)$$

where $Y_1$, $J_1$, $Y_2$, $J_2$, R, $l_1$, $m_1$, $l_2$ and $m_2$ each has the same meaning as defined for formula (17); Q is a group capable or reacting with a nucleophilic agent.

The following are specific examples of the group capable of reacting with a nucleophilic agent.

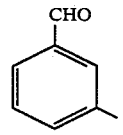

Q-1

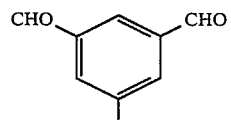

Q-2

$CH_2{=}CHSO_2$— Q-3

$ClCH_2CH_2SO_2$— Q-4

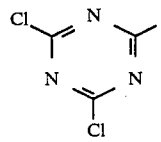

Q-5

—NCO Q-6

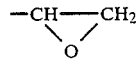

Q-7

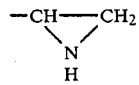

Q-8

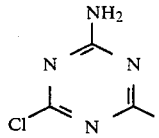

Q-9

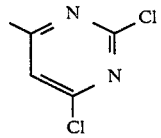

Q-10

Specific examples of the monomer having a group capable of reacting with a nucleophilic agent in the following table:

$$Q-Y_1-J_1-Y_2-J_2-\overset{\overset{\displaystyle R}{|}}{C}=CH_2$$

| Na | Q | $Y_1$ | $J_1$ | $Y_2$ | $J_2$ | R |
|---|---|---|---|---|---|---|
| QM-1 | Q-3 | $-CH_2CH_2-$ | $-OCO-$ | $-CH_2CH_2-$ | $-OCO-$ | $-H$ |
| QM-2 | Q-1 | — | $-NHCO-$ | — | — | $-CH_3$ |
| QM-3 | Q-2 | — | $-NHCO-$ | — | — | $-CH_3$ |
| QM-4 | Q-4 | $-CH_2CH_2-$ | $-CONH-$ | $-CH_2-$ | $-NHCO-$ | $-H$ |
| QM-5 | Q-5 | — | $-NH-$ | $-CH_2CH_2CH_2-$ | $-NHCO-$ | $-CH_3$ |
| QM-6 | Q-5 | — | $-NH-$ | 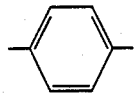 | — | $-H$ |
| QM-7 | Q-3 | $-CH_2CH_2-$ | $-CONH-$ | $-CH_2-$ 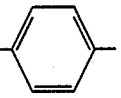 | — | $-H$ |
| QM-8 | Q-6 | 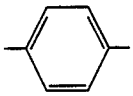 | $-NHCO-$ | — | — | $-CH_3$ |
| QM-9 | Q-7 | $-CH_2-$ | $-OCO-$ | $-CH_2CH_2-$ | $-NHCO-$ | $-CH_3$ |
| QM-10 | Q-7 | $-CH_2-$ | $-OCO-$ | — | — | $-CH_3$ |
| QM-11 | Q-8 | $-CH_2-$ | $-OCO-$ | $-CH_2CH_2-$ | $-NHCO-$ | $-CH_3$ |
| QM-12 | Q-9 | — | $-O-$ | $-CH_2CH_2-$ | $-NHCO-$ | $-CH_3$ |
| QM-13 | Q-9 | — | $-NH-$ | 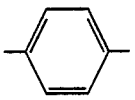 | — | $-H$ |
| QM-14 | Q-10 | — | $-CONH-$ | 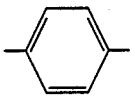 | $-NHCO-$ | $-CH_3$ |

Specific examples of the dye-providing material suitable for use in the present invention are listed below:

1. Non-polymer type

CPM-1

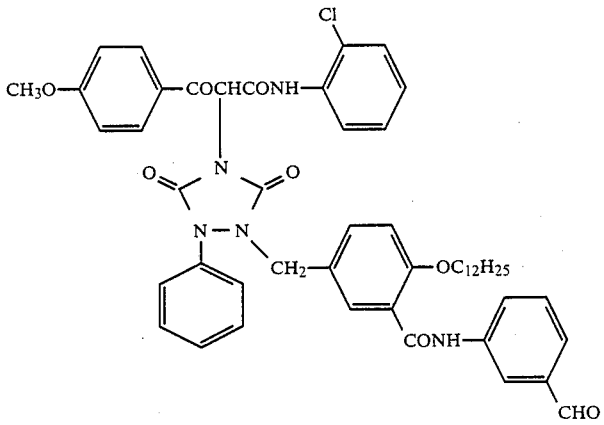

-continued
CPM-2
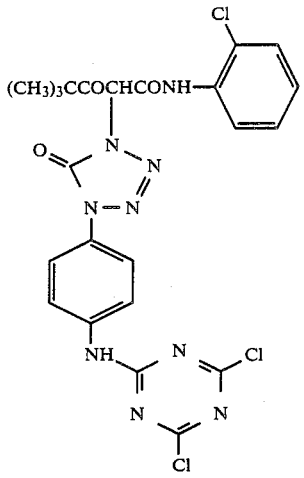
CPM-3
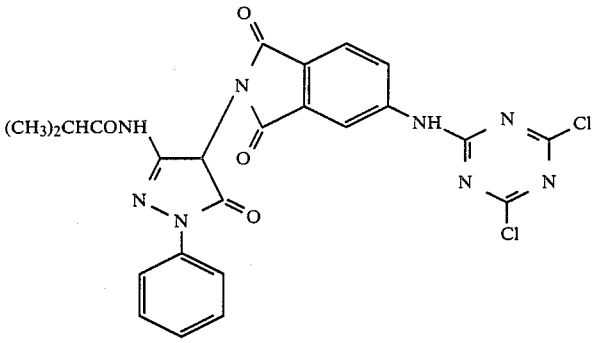
CPM-4
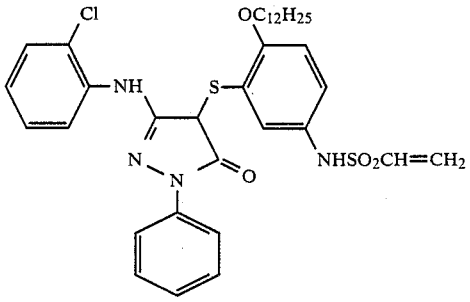
CPM-5
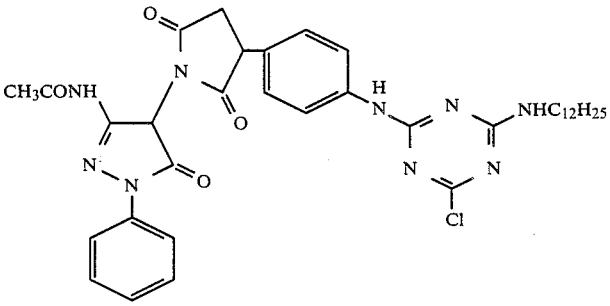

-continued

CPM-6

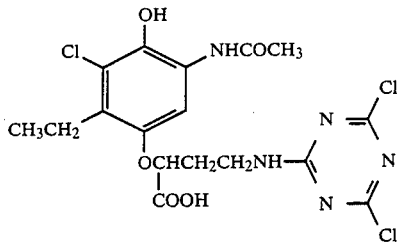

CPM-7

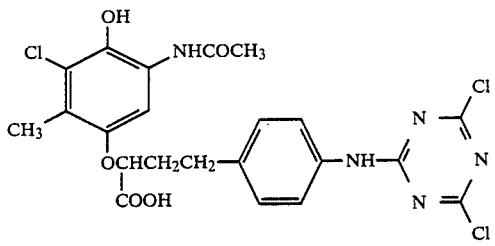

CPM-8

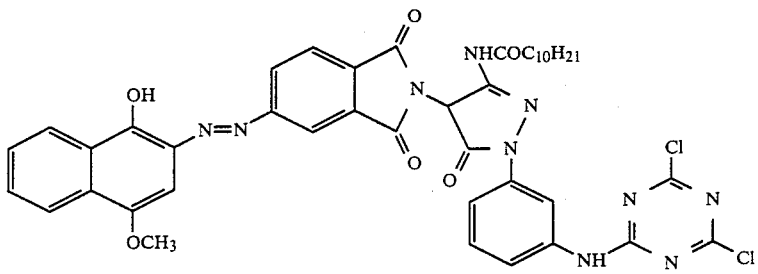

CPM-9

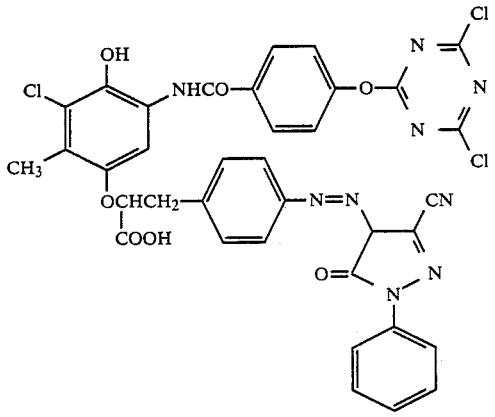

2. Polymer type

| Compound No. | Dye-providing monomer | Monomer having nucleophilic agent-reactive group | Co-monomer | Weight ratio |
|---|---|---|---|---|
| CPM-10 | (A) | QM-2 | butyl acrylate | 5/1/4 |
| CPM-11 | (A) | QM-5 | butyl acrylate | 5/1/4 |
| CPM-12 | (A) | QM-6 | butyl acrylate | 4/1/5 |
| CPM-13 | (B) | QM-1 | butyl acrylate | 4/2/4 |
| CPM-14 | (B) | QM-6 | butyl acrylate | 6/1/3 |
| CPM-15 | (C) | QM-5 | butyl acrylate | 5/2/3 |
| CPM-16 | (C) | QM-8 | butyl acrylate | 4/2/4 |

-continued

| Compound No. | Dye-providing monomer | Monomer having nucleophilic agent-reactive group | Co-monomer | Weight ratio |
|---|---|---|---|---|
| CPM-17 | (D) | QM-5 | butyl acrylate | 4/2/4 |
| CPM-18 | (D) | QM-6 | butyl acrylate | 4/2/4 |
| CPM-19 | (E) | QM-6 | butyl acrylate | 4/2/4 |
| CPM-20 | (F) | QM-6 | butyl acrylate | 4/2/4 |
| CPM-21 | (G) | QM-6 | butyl acrylate | 4/2/4 |

Dye-providing monomers (A) to (G) in the above table have the following formulas:

(A)
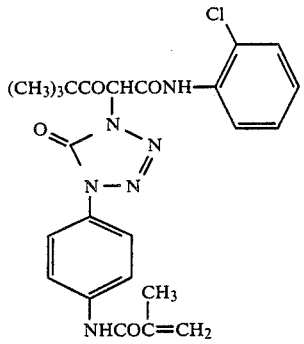
(B)
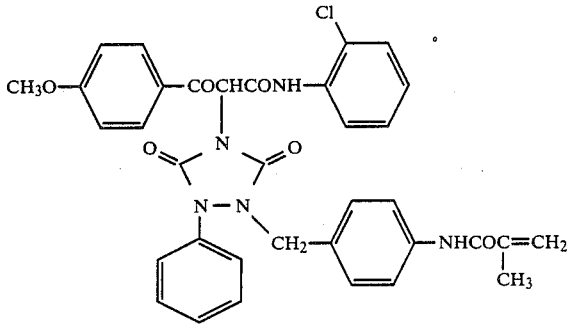
(C)
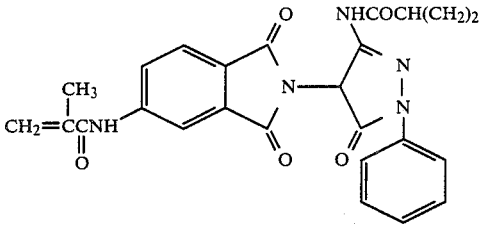
(D)
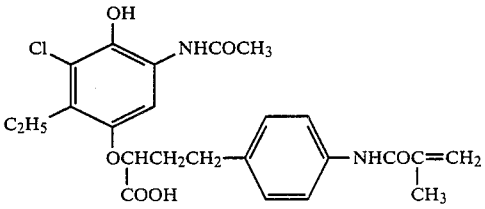
(E)
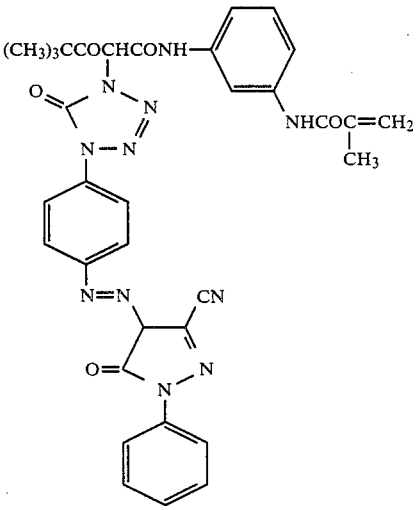

-continued (F)

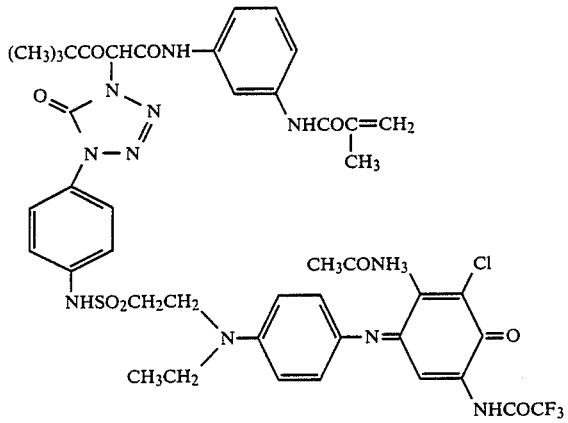

(G)

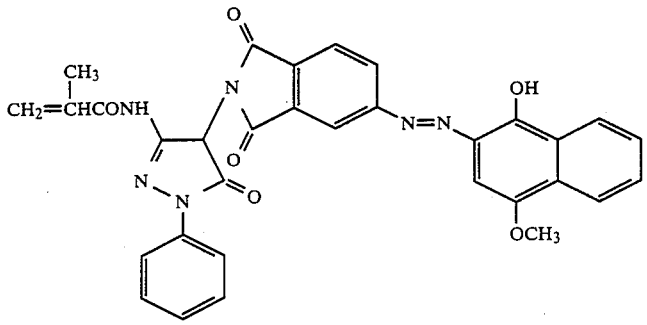

The methods of synthesizing two typical dye-providing materials for use in the present invention are described below.

Synthesis 1

CPM-7:

Cyanuric acid chloride (4.4 g) was dissolved in 100 ml of acetone. After adding 5.3 g of sodium carbonate, the solution was cooled to 5° C. and 7.85 g of α-{(2-methyl-3-chloro-4-hydroxy-5-acylamino) phenoxy}-α-(p-aminophenyl)butyric acid [synthesized according to the method described in Japanese Patent Application (OPI) No. 61158/1986) was slowly added with stirring.

The solution was stirred for an additional 2 hours at 5° C. and subjected to filtration. The filtrate was poured into ice-cooled water and the precipitating solid was separated by filtration. The recovered solid was dried and recrystallized with acetonitrile to obtain the end compound in a yield of 5.9 g.

Synthesis 2

CPM-10:

Five grams of dye-providing monomer (A), 1 g of QM-2 and 4 g of butyl acrylate were dissolved in 100 ml of dioxane and the solution was heated to 70° C. under a nitrogen stream. With this temperature maintained, 200 mg of 2,2'-azobisisobutyronitrile was added and reaction was performed for 4 hours. Following addition of another 200 ml of 2,2'-azobisisobutyronitrile, the reaction was continued for 4 hours. The reaction solution was cooled and poured into ice water. The precipitating solid was separated by filtration and dried to obtain the end compound in a yield of 8.6 g.

The dye-providing materials according to the present invention may be used either independently or as admixtures. The amount of the dye-providing materials used is by no means limited and may be determined according to their type, the manner in which they are used (i.e., either singly or in combination) or the number of photographic constituent layers of which the light-sensitive material of the present invention is composed (i.e., a single layer or two or more layers in superposition). As a guide, the dye-providing materials may be used in an amount of 0.005–50 g, preferably 0.1–10 g, per square meter.

The dye-providing materials for use in the present invention may be incorporated in photographic constituent layers in a thermally developable light-sensitive material by any suitable method. For instance, the dye-providing materials are dissolved in low-boiling solvents (e.g., methanol, ethanol and ethyl acetate) and/or high-boiling solvents (e.g., dibutyl phahlate, dioctyl phthalate and tricresyl phosphate) and uniform dispersions are made by treatment with ultrasonic waves. Alternatively, the dye-providing materials are dissolved in alkaline aqueous solutions (e.g., a 10% aqueous solution of sodium hydroxide) and neutralized with mineral acids (e.g., hydrochloric acid or nitric acid). In another method, the dye-providing materials are dispersed together with aqueous solutions of appropriate polymers (e.g., gelatin, polyvinylbutyral and polyvinylpyrrolidone) by means of a ball mill.

The nucleophilic agent to be used in the present invention may be any compound capable of reacting with the reactive group of said dye-providing material, but preferred are compounds having a nucleophilic group selected from amino, hydroxy and mercapto groups. The nucleophilic agent may be a high molecular compound or a low molecular compound, examples of the former including polymers having said nucleophilic group that can be used as binders, for example, gelatin, polyvinylalcohol and the like, and examples of the latter including compounds having two or more of said nucleophilic group, for example, ethylenediamine, propylenediamine, hexamethylenediamine, resorcinol, ethyleneglycol, 1,6-hexanediol, 1,6-hexanedithiol, m-phenylenediamine and the like.

However, when the dye-providing material is reacted with the nucleophilic agent at the time of preparing the light-sensitive material of the present invention, a high molecular compound other than said polymer which can be used as a binder may be used as a nucleophilic agent, examples of said high molecular compound including polymers having an amino, hydroxy or mercapto group, for example, those mentioned below;

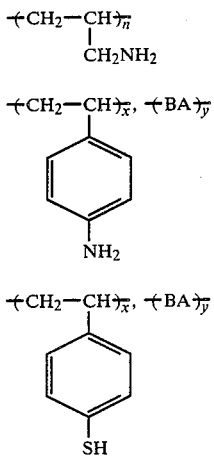

x: 60 wt %
y: 40 wt %
BA: n-butylacrylate

The amount of said nucleophilic agent to be used usually differs depending upon the kind of dye-providing material to be used, but is preferably from 0.1 to 10 moles per mole of the reactive group of said dye-providing material.

The dye-providing material to be used in the present invention reacts with the nucleophilic agent during preparation, storage or development of the light-sensitive material of the present invention, whereby the diffusibility of said substance in reduced, exhibiting the effect of the present invention. In one preferred embodiment of the present invention, a high molecular compound of the type mentioned above is used as a nucleophilic agent, in which case the dye-providing material reacts during thermal development with said high molecular compound in the layer containing said material or with said high molecular compound in an intermediate layer adjacent to said layer, whereby said dye-providing material is prevented from diffusing into other layers containing other dye-providing materials.

In another preferred embodiment, the dye-providing material is reacted at least in part thereof with the nucleophilic agent during preparation of the light-sensitive material of the present invention, whereby the immobility of said material is improved. In this embodiment, if the nucleophilic agent is said high molecular compound, the dye-providing material may be either a low molecular or a high molecular compound; if said material is a high molecular compound, it cross-links to improve its immobility, so that the nucleophilic agent may be a low molecular compound.

The dye-providing material and the nucleophilic agent are preferably reacted in a dispersing or coating solution after dispersion of the dye-providing material. If they are reacted before dispersion of the dye-providing material, the solubility of said material lowers, whereby addition of said material into the light-sensitive material becomes difficult in some cases.

Also, in either embodiment, in order to improve the immobility of the dye-providing material, it is preferable that said material be a high molecular compound, particularly a polymer of the type mentioned above.

Illustrative binders that can be employed in the thermally developable light-sensitive material of the present invention include: synthetic high-molecular compounds such as polyvinylbutyral, polyvinyl acetate, ethyl cellulose, polymethyl methacrylate, cellulose acetate butyrate, polyvinyl alcohol and polyvinylpyrrolidone; synthetic or natural high-molecular compounds such as gelatin, gelatin derivatives (e.g., phthalated gelatin), cellulose derivatives, proteins, starches, and gum arabic. These high-molecular compounds may be used either singly or in combination. It is particularly preferred to employ gelatin or its derivatives in combination with synthetic hydrophilic polymers such as polyvinylpyrrolidone and polyvinyl alcohol. A more preferred binder is a mixture of gelatin and polyvinylpyrrolidone (including copolymers of vinylpyrrolidone and other monomers) as disclosed in Japanese Patent Application (OPI) No. 229556/1984.

The binders are generally used in amounts ranging from 0.05 to 50 g, preferably from 0.1 to 10 g, per square meter of a support.

The binders are preferably used in amounts of 0.1–10 g, more preferably 0.25–4 g, per gram of the dye-providing material.

Light-sensitive silver halides that can be used in the present invention include silver chloride, silver bromide, silver iodide, silver chlorobromide, silver chloroiodide, silver iodobromide and silver chloroiodobromide. These light-sensitive silver halides can be prepared by the single-jet method, double-jet method, or any other method known in the photographic art. According to a preferred embodiment, a silver halide emulsion having silver halide grains with a shell may be employed.

If desired, a silver halide emulsion having silver halide grains with a duplex structure (i.e., the halide composition of the grain surface differing from that of the interior) may be used and an example of such duplex grains is ore/shell type silver halide grains. The shell of these grains may change in halide composition stepwise or gradually. The silver halide grains used may have a well-defined crystal habit as in cubes, spheres, octahedra, dodecahedra or tetradecahedra. Alternatively, they may not have any well-defined crystal habit. Suitable silver halides are shown in Japanese Patent Application (OPI) No. 75435/1987.

A silver halide emulsion comprising tabular silver halide grains of the type described in Japanese Patent Application (OPI) Nos. 111933/1983, 111934/1983, 108526/1983 and Research Disclosure No. 22534 may also be used; such grains have two parallel crystal planes each of which has a greater area than any other single crystal of these grains and the aspect ratio (i.e., diameter-to-thickness ratio) of these grains is at least 5:1.

The present invention also permits the use of a silver halide emulsion containing internal latent-image forming silver halide grains whose surface is not prefogged. Examples of such emulsions include: those which comprise silver halide grains having a higher sensitivity in their interior than on the surface, as shown in U.S. Pat. Nos. 2,592,250, 3,206,313, 3,317,322, 3,511,662, 3,447,927, 3,761,266, 3,703,584 and 3,736,140; those which comprise silver halide grains having polyvalent metal ions incorporated therein, as shown in U.S. Pat. Nos. 3,271,157, 3,447,927 and 3,531,291; those which comprise dopant-containing silver halide grains with their surface being chemically sensitized by a small extent, as shown in U.S. Pat. No. 3,761,276; those which comprise grains with a laminated structure, as shown in Japanese Patent Application (OPI) Nos. 8524/1975 and 38525/1975; and silver halide emulsions of the type described in Japanese Patent Application (OPI) Nos. 156614/1977 and 127549/1980.

The light-sensitive silver halide emulsions illustrated above may be chemically sensitized by any of the methods commonly employed in the photographic art.

The silver halide grains in these light-sensitive emulsions may be coarse or fine; preferred grain sizes are in the order of 0.001 μm to 1.5 μm in diameter, with the range of from about 0.01 to about 0.5 μm being more preferred.

According to another method for preparing light-sensitive silver halides, a light-sensitive silver salt forming component may be used in the presence of organic silver salts (to be described below) so as to form light-sensitive silver halides in part of the organic silver salts.

These light-sensitive silver halides and light-sensitive silver salt forming component may be used in combination in a variety of methods, and the amount used in one photographic layer preferably ranges from 0.001 to 50 g, more preferably 0.1–10 g, per square meter of support.

Typical examples of the spectral sensitizing dyes that can be used in the present invention include cyanine dyes, merocyanine dyes, complex (tri- or tetra-nuclear) cyanine dyes holopolar cyanine dyes, styryl dyes, hemicyanine dyes and oxonole dyes.

These sensitizing dyes are incorporated in amounts ranging from $1\times10^{-4}$ to 1 mole, preferably from $1\times10^{-4}$ to $1\times10^{-1}$ mole, per mole of light-sensitive silver halide or silver halide forming component.

A variety of organic silver salts may optionally be employed in the thermally developable light-sensitive material of the present invention in order to increase its sensitivity or improve its developability.

Illustrative organic silver salts that may be employed in the thermally developable light-sensitive material of the present invention include: silver salts of long-chain aliphatic carboxylic acids and silver salts of carboxylic acids having a hetero ring, such as silver laurate, silver myristate, silver palmitate, silver stearate, silver arachidonate, silver behenate and silver α-(1-phenyltetrazolethio)acetate (see Japanese Patent Publication No. 4921/1968, Japanese Patent Application (OPI) Nos. 52626/1974, 141222/1977, 36224/1978, 37610/1978, U.S. Pat. Nos. 3,330,633, 3,794,496 and 4,105,451); silver salts of aromatic carboxylic acids such as silver benzoate and silver phthalate; and silver salts of an imino group as described in Japanese Patent Publication Nos. 26582/1969, 12700/1970, 18416/1970, 22185/1970, Japanese Patent Application (OPI) Nos. 137321/1977, 118638/1983, 118639/1983, and U.S. Pat. No. 4,123,274.

Also usable are silver complex compounds having a stability constant of 4.5–10.0 as described in Japanese Patent Application (OPI) No. 31728/1977 and silver salts of imidazo linethione of the type described in U.S. Pat. No. 4,168,980.

Among the organic silver salts listed above, silver salts of an imino group are preferred. Particularly preferred are silver salts of benzotriazole derivatives such as 5-methylbenzotriazole or derivatives thereof, sulfobenzotriazole or derivatives thereof and N-alkylsulfamoylbenzotriazole or derivatives thereof.

These organic silver salts may be used either singly or as admixtures in the present invention. Silver salts prepared in suitable binders may be immediately used without being isolated. Alternatively, isolated silver salts may be dispersed in binders by suitable means before they are used. Methods of obtaining dispersions are illustrated by, but are in no way limited, to a ball mill, a sand mill, a colloid mill, a vibration mill, etc.

Organic silver salts are generally prepared by dissolving silver nitrate and starting organic compounds in water or suitable organic solvents and mixing the ingredients. If desired, the dissolution of organic compounds may be promoted by adding binders or alkalis such as sodium hydroxide. It is also effective to use an ammoniacal silver nitrate solution.

The organic silver salts are preferably used in amounts ranging from 0.01 to 500 moles, more preferably from 0.1 to 100 moles, most preferably from 0.3 to 30 moles, per mole of light-sensitive silver halide.

Reducing agents commonly employed in the field of thermally developable light-sensitive materials may be used in the light-sensitive material of the present invention.

If the dye-providing materials used in the thermally developable light-sensitive material of the present invention are of the type that releases or forms a diffusible dye upon coupling reaction with the oxidized product of a reducing agent, the present invention permits the use of such reducing agents as p-phenylenediamine-based or p-aminophenolic developing agents, phosphoroamidophenolic or sulfonamidophenolic developing agents, sulfonamidoaniline-based developing agents, and hydrazone-based color developing agents, all these being described in U.S. Pat. Nos. 3,531,286, 3,761,270, 3,764,328, Research Disclosure Nos. 12146, 15108, 15127, and Japanese Patent Application (OPI) No. 27132/1981. It is also advantageous to use precursors of color developing agent as described in U.S. Pat. Nos. 3,342,599, 3,719,492, and Japanese Patent Application (OPI) Nos. 135628/1978 and 79035/1982.

Particularly preferred reducing agents are N-(p-N,N-dialkylphenyl)-sulfamic acid salts of the type described in Japanese Patent Application (OPI) Nos. 146133/1981 and 227141/1987.

The reducing agents listed above may be used either independently or as admixtures. They may also be used in combination with black-and-white developing agents for attaining such purposes as enhanced developability.

If the dye-providing materials used in the present invention are of such compounds as those which release dyes upon oxidation, those which are oxidized to lose their dye releasing capability, or those which release dyes upon reduction, or in the case where it is simply desired to obtain silver image, the following developing agents may be employed, such as phenols, sulfonamidophenols, polyhydroxybenzenes, naphthols, hydroxybinaphthyls, methylenebisnaphthols, methylenebisphenols, ascorbic acids, 3-pyrazolidones, pyrazolones, hydrazones, and paraphenylenediamines.

These developing agents may also be used either independently or as admixtures.

The amount in which the reducing agents are used in the thermally developable light-sensitive material of the present invention depend upon many factors such as the type of light-sensitive silver halide used, the type of organic acid silver salt, and the type of other additives used. Usually, the reducing agents are used in amounts ranging from 0.01 to 1,500 moles per mole of light-sensitive silver halide, with the range of 0.1–200 moles being preferred.

A variety of supports can be used with the thermally developable light-sensitive material of the present invention and they include: synthetic plastic films such as a polyethylene film, a cellulose acetate film, a polyethylene terephthalate film, and a polyvinyl chloride film; paper supports such as photographic raw paper, printing paper baryta paper and resin-coated paper; and supports prepared by coating these materials with electron-beam curable resin compositions, followed by curing of the same.

In the thermally developable light-sensitive material of the present invention and if this material is of the transfer type and used with an image-receiving member, a variety of thermal solvents are preferably incorporated in the light-sensitive material and/or the image-receiving member. thermal solvents usable in the present invention are compounds capable of promoting thermal development and/or heat transfer. Examples of such compounds are the polar organic compounds that are described in U.S. Pat. Nos. 3,347,675, 3,667,959, Research Disclosure No. 17643 (XII), Japanese Patent Application (OPI) Nos. 229556/1984, 68730/1984, 84236/1984, 191251/1985, 232547/1985, 14241/1985, 52643/1986, 78553/1987, 42153/1987, 44737/1987, U.S. Pat. Nos. 3,438,776, 3,666,477, 3,667,959, Japanese Patent Application (OPI) Nos. 19525/1976, 24829/1978, 60223/1978, 118640/1983, and 198038/1983. Particularly useful compounds are: urea derivatives (e.g., dimethylurea, diethylurea and phenylurea), amide derivatives (e.g., acetamide, benzamide, p-toluamide and p-butoxybenzamide), sulfonamide derivatives (e.g., benzenesulfonamide and α-toluenesulfonamide), and polyhydric alcohols (e.g., 1,5-pentanediol, 1,6-hexanediol, 1,2-cyclohexanediol, pentaerythritol and trimethylolethane), and polyethylene glycol.

The following water-insoluble solid thermal solvents may be used with particular advantage.

Water-insoluble solid thermal solvents are those compounds which are solid at ambient temperature but which become liquid at elevated temperatures (60° C. and above, preferably 100° C. and above, more preferably 130°–250° C.). These compounds have ratios of inorganicity to organicity (see "Yuki Gainenzu (Diagrams for the Concept of Organic Compounds)", by Y. Koda, Sankyo Shuppan, 1984) in the range of 0.5–3.0, preferably 0.7–2.5, more preferably 1.0–2.0.

Specific examples of such water-insoluble thermal solvents are given in Japanese Patent Application (OPI) Nos. 136645/1987 and 139549/1987.

Thermal solvents may be incorporated in various layers such as light-sensitive silver halide emulsion layers, intermediate layers, protective layers, and image-receiving layers in an image-receiving member so that the results desired in respective cases can be obtained.

Thermal solvents are usually incorporated in amounts ranging from 10 to 500 wt %, preferably from 30 to 200 wt %, of the binder.

Besides the components described above, the thermally developable light-sensitive material of the present invention may incorporate various other additives.

Compounds known as toning agents in the art of thermally developable light-sensitive materials may be incorporated as development accelerators in the thermally developable light-sensitive material of the present invention. Illustrative toning agents are described in such prior patents as Japanese Patent Application (OPI) Nos. 4928/1971, 6077/1971, 5019/1974, 5020/1974, 91215/1974, 107727/1974, 2524/1975, 67132/1975, 67641/1975, 114217/1975, 33722/1977, 99813/1977, 1020/1978, 55115/1978, 76020/1978, 125014/1978, 156523/1979, 156524/1979, 156525/1979, 156526/1979, 4060/1980, 4061/1980, 32015/1980, West German Patent Nos. 2,140,406, 2,141,063, 2,220,618, U.S. Pat. No. 3,847,612, 3,782,941, 4,201,582, and Japanese Patent Application (OPI) Nos. 207244/1982, 207245/1982, 189628/1983 and 193541/1983.

Other compounds useful as development accelerators are those described in Japanese Patent application (OPI) Nos. 177550/1984 and 111636/1984. A compound capable of releasing development accelerators is described in Japanese Patent Application (OPI) No. 159642/1986 and this may also be used in the present invention.

Antifoggants may be incorporated in the thermally developable light-sensitive material of the present invention. Illustrative antifoggants include: the higher aliphatic compound described in U.S. Pat. No. 3,645,739; the mercuric salt described in Japanese Patent Publication No. 11113/1972; the N-halogen compound described in Japanese Patent Application (OPI) No. 47419/1976, the mercapto compound releasing compounds described in U.S. Pat. No. 3,700,457 and Japanese Patent Application (OPI) No. 50725/1976; the arylsulfonic acid described in Japanese Patent Application (OPI) No. 125016/1974; the lithium salt of a carboxylic acid described in Japanese Patent Application (OPI) No. 47419/1976; the oxidizing agents described in BP 1,455,271 and Japanese Patent Application (OPI) No. 101019/1975; the sulfinic acids or thiosulfonic acids described in Japanese Patent Application (OPI) No. 19825/1978; 2-thiouracils described in Japanese Patent Application (OPI) No. 3223/1976; the elemental sulfur described in Japanese Patent Application (OPI) No. 26019/1976; the disulfide and polysulfide compounds described in Japanese Patent Application (OPI) Nos. 42529/1976, 81124/1976 and 93149/1980; the rosin or diterpenes described in Japanese Patent Application (OPI) No. 57435/1976; polymeric acids having a free carboxylic or sulfonic acid group as described in Japanese Patent Application (OPI) No. 104338/1976; the thiazolinethione described in U.S. Pat. No. 4,138,265; the 1,2,4-triazole or 5-mercapto-1,2,4-triazole described in Japanese Patent Application (OPI) No. 51821/1979 and U.S. Pat. No. 4,137,079; the thiosulfinic acid esters described in Japanese Patent Application (OPI) No. 140833/1980; the 1,2,3,4-thiatriazoles described in Japanese Patent Application (OPI) No. 142331/1980; the dihalogen or trihalogen compounds described in Japanese Patent Application (OPI) Nos. 46641/1984, 57233/1984 and 57234/1984; the thiol compound described in Japanese Patent Application (OPI) No. 111636/1984; the hydroquinone derivative described in Japanese Patent application (OPI) no. 198540/1985; and the use of hydroquinone and benzotriazole derivatives as shown in Japanese Patent Application (OPI) No. 227255/1980.

Other preferred antifoggants include the restrainer having a hydroxyl group that is described in Japanese Patent Application (OPI) No. 78554/1987, the polymeric restrainer described in Japanese Patent Application (OPI) No. 121452/1987, and the restrainer compound having a ballast group that is described in Japanese Patent Application (OPI) No. 123456/1987.

The thermally developable light-sensitive material of the present invention may also incorporate inorganic or organic bases or base precursors. Illustrative base precursors include compounds that undergo decarboxylation upon heating to release a basic substance (e.g., guanidium trichloroacetate) and compounds that are decomposed by reactions such as intramolecular nucleophilic substitution reaction to release amines. Examples of such base releasers are described in many prior patents such as Japanese Patent Application (OPI) Nos. 130745/1981, 132332/1981, BP 2,079,480, U.S. Pat. No. 4,060,420, Japanese Patent Application (OPI) Nos. 157637/1984, 166943/1984, 180537/1984, 174830/1984 and 195237/1984.

Other additives that are used as required in thermally developable light-sensitive materials may also be incorporated in the thermally developable light-sensitive material of the present invention. Illustrative additives include anti-halation dyes, brighteners, hardeners, antistats, plasticizers, extenders, matting agents, surface-active agents and anti-fading agents. Specific examples are given in Research Disclosure, Vol. 170, No. 17029, June 1978, and Japanese Patent application (OPI) No. 135825/1987.

In a basic mode, the thermally developable light-sensitive material of the present invention preferably contains (1) a light-sensitive silver halide, (2) a reducing agent, (3) a dye-providing material, (4) a binder, and optionally (5) an organic silver salt, in one thermally developable light-sensitive layer. These components are not necessarily incorporated in a single photographic constituent layer and may be incorporated in two or more constituent layers in such a way that they are held mutually reactive. In one instance, a thermally developable light-sensitive layer is divided into two sub-layers and components (1), (2), (4) and (5) are incorporated in one sub-layer with dye-providing material (3) being incorporated in the other sub-layer which is adjacent to the first sub-layer.

If desired, the thermally developable light-sensitive layer may be divided into two or more layers including a highly sensitive layer and a less sensitive layer, or a high-density layer and a low-density layer.

The thermally developable light-sensitive material of the present invention has one or more thermally developable light-sensitive layers on a support. A thermally developable color light-sensitive material generally has three thermally developable light-sensitive layers having different color sensitivities, each light-sensitive layer forming or releasing a dye of different color as a result of thermally development. A blue-sensitive layer is usually combined with a yellow dye, a green-sensitive layer with a magenta dye, and a red-sensitive layer with a cyan dye. Other combinations may of course be employed. Combination with a near infrared sensitive layer is also possible.

The choice of layer arrangements depends on the objective of a specific use. For instance, a support is coated with a red-sensitive, a green-sensitive and a blue-sensitive layer, or in the reverse order (i.e., a blue-sensitive, a green-sensitive and a red-sensitive layer), or a support may be coated with a green-sensitive, a red-sensitive and a blue-sensitive layer.

Besides the thermally developable light-sensitive layers described above, the thermally developable light-sensitive material of the present invention may incorporate non-light-sensitive layers such as a subbing layer, an intermediate layer, a protective layer, a filter layer, a backing layer and a release layer. The thermally developable light-sensitive layers and these non-light-sensitive layers may be applied to a support by coating techniques that are similar to those commonly employed to coat and prepare ordinary silver halide light-sensitive materials.

The thermally developable light-sensitive material of the present invention is developed after imagewise exposure and this can usually be done by merely heating the material at a temperature in the range of 80°–200° C., preferably 100°–170° C., for a period of from 1–180 seconds, preferably 1.5–120 seconds. A diffusible dye may be transferred onto an image-receiving layer simultaneously with thermally development by bringing the image-receiving layer in the image-receiving member into intimate contact with the light-sensitive surface of the light-sensitive material; alternatively, the light-sensitive material brought into intimate contact with the image-receiving member after thermally development may be subsequently heated. In another method, water is supplied before the two members are brought into intimate contact with each other and the assembly is subsequently heated if desired. The light-sensitive material may be preliminarily heated in the temperature range of 70°–180° C. prior to exposure. In order to enhance the adhesion between the light-sensitive material and the image-receiving member, they may be separately heated at a temperature of 80°–250° C. just prior to thermally development and transfer, as described in Japanese Patent Application (OPI) Nos. 143338/1985 and 162041/1986.

The thermally developable light-sensitive material of the present invention permits the use of a variety of known exposure techniques.

All methods of heating that can be used with ordinary thermally developable light-sensitive materials may be applied to the thermally developable light-sensitive material of the present invention. In one instance, the light-sensitive material may be brought into contact with a heated block or plate, or with heated rollers or a hot drum. Alternatively, the material may be passed through a hot atmosphere. High-frequency heating is also applicable. In still another method, an electroconductive layer containing a conductive material such as carbon black is provided either on the back side of the light-sensitive material of the present invention or on the surface of an image-receiving member for heat-transfer and an electric current is applied to generate the Joule heat as heating energy. The heating pattern is in no way limited; preheating may be followed by another cycle of heating; heating may be performed for a short period at high temperatures or for a long period at low temperatures; the temperature may be elevated and lowered continuously; repeated cycles of heating may be employed; the heating may be discontinuous rather than continuous. In any event, a simple heating pattern is preferred. If desired, exposure and heating may proceed simultaneously.

Any image-receiving member may effectively be used in the present invention if the image-receiving layer employed has a capability for accepting the dye released or formed in the thermally developable light-sensitive layer as a result of thermally development. A preferred example is a polymer containing a tertiary: amine or quaternary ammonium salt, as described in U.S. Pat. No. 3,709,690. Typical image-receiving layers suitable for use in diffusion transfer can be prepared by coating a support with a mixture in which a polymer containing an ammonium salt or tertiary amine is combined with gelatin or polyvinyl alcohol. Another useful dye-receiving layer may be formed of a heat-resistant organic high-molecular substance having a glass transition point of 40°–250° C. as described in Japanese Patent Application (OPI) No. 207250/1982.

These polymers may be carried as image-receiving layers on a support; alternatively, they may be used as supports on their own.

Illustrative heat-resistant organic high-molecular substances include: polystyrene, polystyrene derivatives having substituents with no more than 4 carbon atoms, polyvinyl cyclohexane, polydivinylbenzene, polyvinylpyrrolidone, polyvinylcarbazole and polyallylbenzene, polyacetals such as polyvinyl alcohol, polyvinyl formal and polyvinyl butyral; polyvinyl chloride, chlorinated polyethylene, poly(ethylene tetrachlorofluoride), polyacrylnitrile, and poly-N,N-dimethylallylamide; polyesters such as polyacrylates having a p-cyanophenyl group, a pentachlorophenyl group or a 2,4-dichlorophenyl group, polyacrylchloroacrylate, polymethyl methacylate, polyethyl methacrylate, polypropyl methacrylate, polyisopropyl methacrylate, polyisobutyl methacrylate, polytert-butyl methacrylate, polycyclohexyl methacrylate, polyethylene glycol dimethacrylate, poly-2-cyano-ethyl methacrylate, and polyethylene terephthalate; polysulfones; polycarbonates such as bisphenol A polycarbonate; polyanhydrides; polyamides; and cellulose acetates. Synthetic polymers having glass transition points of 40° C. and above as described in "Polymer Handbook", 2nd ed., edited by J. Brandrup and E. H. Immergut, John Wiley & Sons are also useful. Useful molecular weights of these high-molecular substances are generally in the range of 2,000–200,000. These high-molecular substances may be used either independently or as blends. Two or more monomers may be employed to make copolymers.

Particularly preferred image-receiving layers include the polyvinyl chloride layer described in Japanese Patent Application (OPI) No. 223425/1984 and the layer described in Japanese Patent Application (OPI) No. 19138/1985 that comprises a polycarbonate and a plasticizer.

The polymers described above may be used as supports that also serve as image-receiving layers to form image-receiving members.

In this case, the support may be formed of a single layer or two or more layers.

Supports for image-receiving members may be transparent or non-transparent. Illustrative supports include: films of polymers such as polyethylene terephthalate, polycarbonate, polystyrene, polyvinyl chloride, polyethylene and polypropylene; supports having pigments such as titanium oxide, barium sulfate, calcium carbonate and talc incorporated in these plastic films; baryta paper; resin-coated (RC) paper having paper laminated with pigment-loaded thermoplastic resins; fabrics; glass; metals such as alminum; supports prepared by coating these materials with pigment-loaded electron beam curable resin compositions, followed by curing of the latter; and supports having pigment-loaded coating layers on these materials. Also usable as a support is the cast-coated paper described in Japanese Patent Application No. 126972/1986.

Particularly useful are the support prepared by coating paper with a pigment-loaded electron-beam curable resin composition, followed by curing of the resin, and the support prepared by applying a pigment coating layer to paper, which is then coated with an electron-beam curable resin composition, followed by curing of the resin. These supports can immediately be used as image-receiving layers since the resin layer itself serves as an image-receiving layer.

The thermally developable light-sensitive material of the present invention is preferably provided which a protective layer.

The protective layer may contain a variety of additives that are commonly employed in the photographic industry. Suitable additives include matting agents, colloidal silica, slip agents, organofluoro compounds (in particular, fluorine-based surface active agents), antistats, uv absorbers, high-boiling organic solvents, antioxidants, hydroquinone derivatives, polymer latices, surface-active agents (including high-molecular surface-active agents), hardeners (including high-molecular hardeners), particulate organic silver salts, and non-light-sensitive silver halide grains.

For details of these additives, reference should be made to Research Disclosure, Vol. 170, No. 17029, June 6, 1978, and Japanese Patent Application (OPI) No. 135825/1987.

The following examples are provided for the purpose of further illustrating the present invention but are in no way to be taken as limiting.

EXAMPLE 1

Preparation of silver iodobromide emulsion:

To solution (A) having ossein gelatin (20 g) and ammonia dissolved in distilled water (1,000 ml), 500 ml of aqueous solution (B) containing 11.6 g of potassium iodide and 131 g of potassium bromide and 500 ml of aqueous solution (C) containing 1 mole of silver nitrate and ammonia were added simultaneously, with the pAg being controlled to be constant, at 50° C. using a mixer/stirrer of the type described in Japanese Patent Application (OPI) Nos. 92523/1982 and 92524/1982. The shape and size of the grains in the emulsion being prepared were adjusted by controlling the pH, pAg and the rates at which solutions (B) and (C) were added. In this way, a core emulsion comprising octahedral grains with 7 mol % AgI and an average size of 0.25 μm was prepared. By repeating the above procedures, the core grains were coated with a silver halide shell having 1 mol % AgI, so as to prepare a core/shell type silver halide emulsion comprising octahedral grains with an average size of 0.3 μm. These grains had a monodispersity of 9%. The so prepared emulsion was washed with water and desalted. The overall yield of emulsion was 800 ml.

Using this emulsion, a red-sensitive, a green-sensitive and a blue-sensitive AgBrI emulsion were prepared according to the following formulations.

(a) Red-sensitive AgBrI emulsion

AgBrI emulsion: 700 ml

4-Hydroxy-6-methyl-1,3,3a,7-tetrazaindene: 0.4 g
Gelatin: 32 g
Sodium thiosulfate: 10 mg
Sensitizing dye (a) (1% MeOH sol.): 80 ml
Distilled water: 1200 ml Sensitizing dye (a)

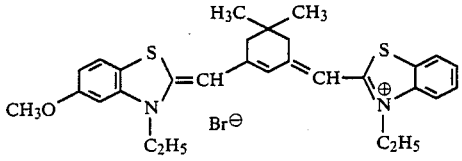

(b) Green-sensitive AgBrI emulsion
AgBrI emulsion: 700 ml
4-Hydroxy-6-methyl-1,3,3a,7-tetrazaindene: 0.4 g
Gelatin: 32 g
Sodium thiosulfate: 10 mg
Sensitizing dye (b) (1% MeOH sol.): 80 ml
Distilled water: 1200 ml Sensitizing dye (b)

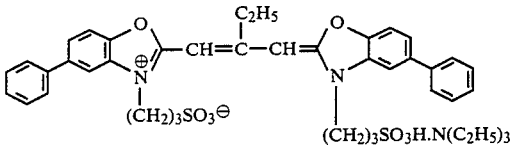

(c) Blue-sensitive AgBrI emulsion
AgBrI emulsion: 700 ml
4-Hydroxy-6-methyl-1,3,3a,7-tetrazaindene: 0.4 g
Gelatin: 32 g
Sodium thiosulfate: 10 mg
Sensitizing dye (c) (1% MeOH sol.): 80 ml
Distilled water: 1200 ml Sensitizing dye (c)

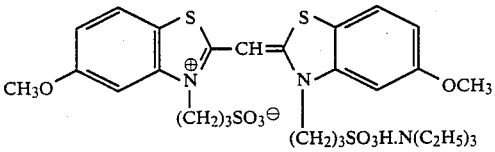

Preparation of a dispersion of organic silver salt:

5-Methyl benzotriazole was reacted with silver nitrate in a mixed solvent of water and alcohol to form 5-methyl benzotriazole. A portion (28.8 g) of this compound was mixed with 16.0 g of poly(N-vinylpyrrolidone) and 1.0 g of 5-methylbenzotriazole in an alumina ball mill to form a dispersion. The pH of this dispersion was adjusted to 5.5 and its volume to 200 ml.

Preparation of a dispersion of dye-providing material:

A hundred and forty grams of dye-providing material (CPM-15), 4.0 g of a hydroquinone compound (for its formula, see below) and 1.0 g of an antifoggant (for its formula, also see below) were dissolved in 300 ml of ethyl acetate. The resulting solution was mixed with 248 ml of a 5 wt % aqueous solution of Alkanol XC (Du Pont) and 1,440 ml of an aqueous gelatin solution containing 26.4 g of photographic gelatin and 34.6 g of phenylcarbamoylated gelatin (Type 17819PC of Lousreau). The mixture was treated with an ultrasonic homogenizer to make a dispersion. After distilling off the ethyl acetate, the pH of the dispersion was adjusted to 5.5 and its volume to 1,590 ml.

Hydroquinone compound

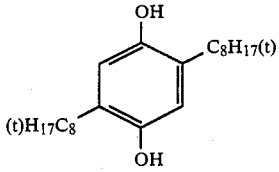

Antifoggant

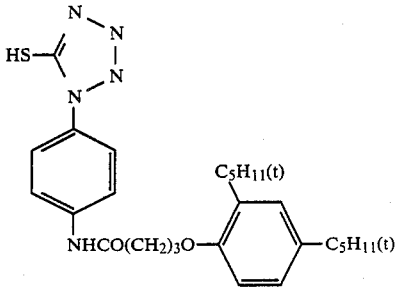

Preparation of a solution of reducing agent:

A reducing agent (93.2 g; for its formula, see below) was mixed with 207 ml of a 20 wt % aqueous solution of polyvinylpyrrolidone (K-30), 40 ml of a 5 wt % aqueous solution of a surface-active agent (for its formula, also see below). The pH of the mixture was adjusted to 7.0 by addition of aqueous citric acid and water was added to make a volume of 600 ml.

Surface-active agent

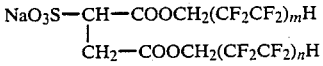

(m and n each represents 2 or 3).

Reducing agent

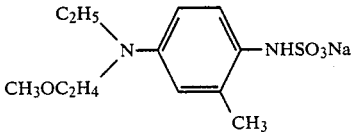

Preparation of a dispersion of thermal solvent:

Three hundred and fifty grams of a thermal solvent (p-n-) butoxybenzamide) was mixed with 70 g of butanetriol and 1,410 ml of a 1.0 wt % aqueous solution of polyvinylpyrrolidone (K-30) in a ball mill to make a dispersion of the thermal solvent. Preparation of thermally developable light-sensitive material:

To a subbed transparent photographic polyethylene terephthalate film 180 μm thick, a coating solution having the composition noted below was applied to give a wet coating thickness of 125 μm and the web was dried to form a thermally developable light-sensitive material.

Coating solution

Dispersion of organic silver salt: 64 ml
Green-sensitive AgBrI emulsion: 30.7 ml
Solution of reducing agent: 38.4 ml
Dispersion of thermal solvent: 94.8 ml
Dispersion of dye-providing material: 101 ml
10 wt % Aqueous solution of photographic gelatin: 21.1 ml
10 wt % Aqueous solution of phenylcarbamoylated gelatin: 27.7 ml
Aqueous citric acid and water (for adjusting pH to 5.5): 89 ml
Aqueous solution of 2.5% 2,4-Dichloro-6-hydroxy-S-triazine sodium: 13.3 ml
Total: 480 ml Preparation of image-receiving member:

A solution of polycarbonate (mol. wt., 25,000; L-1250 of Teijin chemicals Ltd.) in ethylene chloride was coated onto photographic baryta paper and dried to make an image-receiving member having a polycarbonate deposit of 15.0 g/m$^2$.

Evaluation of light-sensitive material

The light-sensitive material prepared by the procedures described above was exposed to green light (800 CMS) through a step wedge.

The image-receiving member was superposed on the exposed light-sensitive material in such a way that the polycarbonate coated side was in contact with the light-sensitive layer. The assembly was subjected to thermally development for 90 seconds at 150° C. and the image-receiving member was peeled off, leaving a magenta transfer image (Dmax, 1.72; Dmin, 0.09) on the image-receiving member.

EXAMPLE 2

To a subbed transparent photographic polyester terephthalate film 180 μm thick, a coating solution was applied to form a first light-sensitive layer having a wet thickness of 65 μm. This coating solution had the same composition as used in Example 1 except that CPM-15 dye-providing material was changed to CPM-17 and that the green-sensitive AgBrI emulsion was changed to the red-sensitive AgBrI emulsion prepared in Example 1.

The first light-sensitive layer was overcoated with a first intermediate layer having the following composition:

Gelatin: 0.6 g/m$^2$
Polyvinylpyrrolidone: 0.3 g/m$^2$
CD' scavenger (see below): 0.2 g/m$^2$
Methyl benzotriazole silver: 0.6 g/m$^2$
p-n-Butoxybenzamide: 0.9 g/m$^2$
2,4-dichloro-6-hydroxy-S-triazine sodium: 10 mg/m$^2$ Onto the first intermediate layer, a coating solution of the same composition as used in Example 1 was applied to form a second light-sensitive layer having a wet thickness of 45 μm.

The second light-sensitive layer was overcoated with a second intermediate layer having the same composition as the first intermediate layer except that it additionally contained a yellow filter dye (0.2 g/m$^2$) having the formula indicated below.

Onto the second intermediate layer, a coating solution was applied to form a third light-sensitive layer having a wet thickness of 65 μm. This coating solution had the same composition as used in Example 1 except that CPM-17 (dye-imparting substance) was changed to CPM-11 and that the green-sensitive AgBrI emulsion was changed to the blue-sensitive emulsion prepared in Example 1.

The third light-sensitive layer was overcoated with a protective layer having the formulation indicated below, so as to prepare a light-sensitive material having three light-sensitive layers in superposition (sample No. 1):

Gelatin: 0.28 g/m$^2$
Polyvinylpyrrolidone: 0.14 g/m$^2$
$SiO_2$: 0.36 g/m$^2$
Saffron: 1.0 g/m$^2$
p-n-Butoxybenzamide: 0.42 g/m$^2$ CD' scavenger Copolymer of

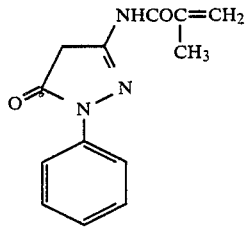

and butyl acrylate (3:2; mol. wt., 11,800)

Yellow filter dye

Copolymer of

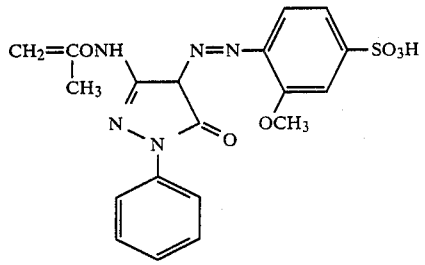

and butyl acrylate (6:5)

The prepared sample (No. 1) of light-sensitive material was exposed to red, green and blue light (800 CMS) and thermally developed as in Example 1 to produce a cyan, a magenta and a yellow transfer image. The densities (Dmax and Dmin) of each of these images are noted in Table 2.

EXAMPLE 3

Sample Nos. 2 to 4 were prepared by repeating the procedures of Example 2 except that the dye-providing materials were changed to the compounds listed in Table 1. Subsequently, Sample No. 5 was prepared in the same manner as in Example 2 except that 6.4 g of hexamethylenetetramine was added to the dye-providing material dispersion used in preparing Sample No. 1 in Example 2. Also, Sample No. 6 was prepared in the same manner as in Example 2 except that 10 g of the following compound was added to the ethyl acetate solution used in preparing said dye-providing material dispersion:

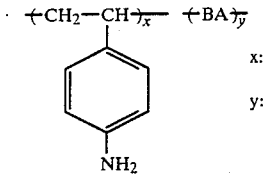

x: 60 wt % y: 40 wt %

The samples thus prepared were exposed to red, green and blue light and thermally developed as in Example 2. The densities of the transfer images produced are noted in Table 2.

TABLE 1

| Sample No. | Red-sensitive layer | Green-sensitive layer | Blue-sensitive layer |
|---|---|---|---|
| 2 (sample of the invention) | CPM-7 | CPM-3 | CPM-2 |
| 3 (sample of the invention) | CPM-20 | CPM-21 | CPM-19 |
| 4 (comparative sample) | (A) | (B) | (C) |

(A)

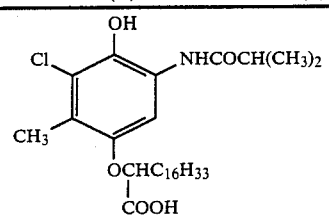

(B)

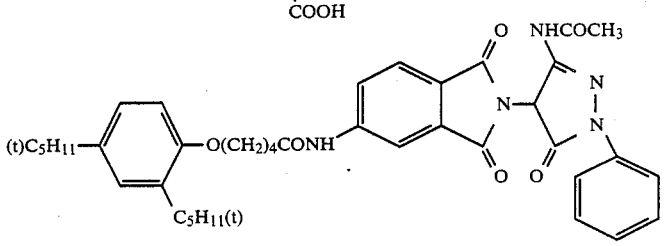

(C)

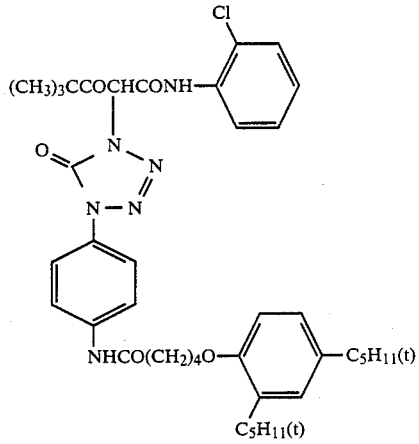

TABLE 2

| Sample No. | Measured light | Exposure blue Dmax | blue Dmin | green Dmax | green Dmin | red Dmax | red Dmin |
|---|---|---|---|---|---|---|---|
| 1 (sample of the invention) | blue | 1.67 | 0.03 | 0.13 | 0.06 | 0.04 | 0.04 |
| | green | 0.52 | 0.05 | 1.74 | 0.06 | 0.32 | 0.04 |
| | red | 0.26 | 0.05 | 0.31 | 0.07 | 1.62 | 0.04 |
| 2 (sample of the invention) | blue | 1.71 | 0.05 | 0.23 | 0.08 | 0.08 | 0.06 |
| | green | 0.69 | 0.06 | 1.75 | 0.08 | 0.41 | 0.06 |
| | red | 0.29 | 0.05 | 0.42 | 0.09 | 1.69 | 0.06 |
| 3 (sample of the invention | blue | 1.58 | 0.04 | 0.12 | 0.06 | 0.05 | 0.05 |
| | green | 0.51 | 0.06 | 1.68 | 0.06 | 0.31 | 0.05 |
| | red | 0.24 | 0.05 | 0.30 | 0.07 | 1.49 | 0.05 |
| 4 (comparative sample) | blue | 1.52 | 0.10 | 0.69 | 0.12 | 0.15 | 0.10 |
| | green | 0.89 | 0.10 | 1.61 | 0.12 | 0.65 | 0.10 |
| | red | 0.27 | 0.10 | 0.78 | 0.13 | 1.59 | 0.10 |
| 5 (sample of the invention) | blue | 1.59 | 0.03 | 0.13 | 0.06 | 0.04 | 0.04 |
| | green | 0.51 | 0.05 | 1.70 | 0.07 | 0.31 | 0.04 |
| | red | 0.25 | 0.05 | 0.30 | 0.07 | 1.58 | 0.04 |
| 6 (sample of the invention) | blue | 1.54 | 0.04 | 0.14 | 0.06 | 0.04 | 0.04 |
| | green | 0.51 | 0.05 | 1.69 | 0.06 | 0.30 | 0.04 |
| | red | 0.24 | 0.04 | 0.29 | 0.07 | 1.56 | 0.04 |

As is clear from Table 2, the comparative sample (No. 4) of a multi-layered light-sensitive material intended for color image production experienced a significant degree of color mixing (e.g., not only a cyan image but also a magenta image was formed in the case of exposure to red light) that caused deteriorated color purity. On the other hand, sample Nos. 1–3, 5 and 6 that employed dye-providing materials within the scope of the present invention were appreciably improved with respect to the color mixing problem. Besides this advantage, the fog occurring in these samples was at such a low level that they successfully produced color images of high color purity.

What is claimed is:

1. A thermally developable light-sensitive material having at least a light-sensitive silver halide, a reducing agent, a binder and a dye-providing material on a support, wherein said dye-providing material is a compound which has a group capable of substitution or addition reaction with a nucleophilic agent and releases or forms a diffusible dye as a function of development.

2. A thermally developable light-sensitive material according to claim 1 wherein said nucleophilic agent is a compound which has at least one group selected from amino, hydroxy and mercapto groups.

3. A thermally developable light-sensitive material according to claim 2 wherein said nucleophilic agent is a high molecular compound which has at least one group selected from amino, hydroxy and mercapto groups.

4. A thermally developable light-sensitive material according to claim 3 wherein said high molecular compound is a binder.

5. A thermally developable light-sensitive material according to claim 2 wherein said nucleophilic agent is a low molecular compound which has at least two groups selected from amino, hydroxy and mercapto groups.

6. A thermally developable light-sensitive material according to claim 1 wherein said dye-providing material has at least in part thereof substitution or addition reacted with said nucleophilic agent.

7. A thermally developable light-sensitive material according to claim 6 wherein said nucleophilic agent is a compound which has at least one group selected from amino, hydroxy and mercapto groups.

8. A thermally developable light-sensitive material according to claim 1 wherein said dye-providing material is a compound in which the residue of a compound capable of releasing or forming a diffusible dye as a function of development and the group capable of substitution or addition reaction with said nucleophilic agent are bonded either directly or via a divalent linkage.

9. A thermally developable light-sensitive material according to claim 8 wherein said residue of a compound capable of forming a diffusible dye is a group represented by the following general formula (1):

$$(\text{Coup})_1\text{—X—} \qquad (1)$$

where $(\text{Coup})_1$ is the residue of a compound which forms a diffusible dye upon coupling reaction with the oxidized product of said reducing agent; and X is a group which is bonded to the active site of $(\text{Coup})_1$ and which is eliminated therefrom during coupling reaction.

10. A thermally developable light-sensitive material according to claim 9 wherein said $(\text{Coup})_1$ is a group represented by either one of the following general formulas (2)–(11):

(2)

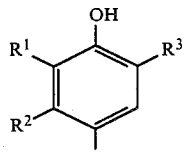

(3)

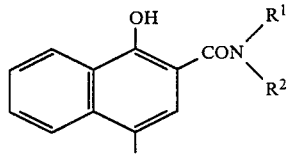

(4)

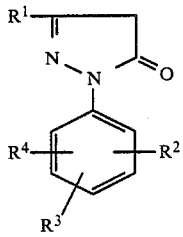

(5)

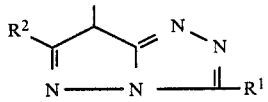

(6)

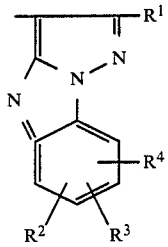

(7)

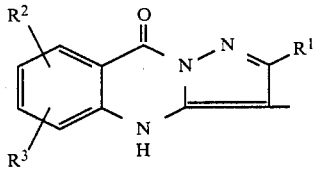

(8)

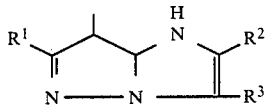

(9)

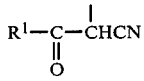

(10)

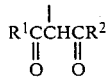

-continued (11)

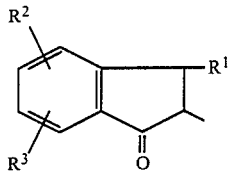

where $R^1$, $R^2$, $R^3$ and $R^4$ each represents a hydrogen atom, a halogen atom, an alkyl group, a cycloalkyl group, an aryl group, an acyl group, an alkyloxycarbonyl group, an aryloxycarbonyl group, an alkylsulfonyl group, an arylsulfonyl group, a carbamoyl group, a sulfamoyl group, an acyloxy group, an amino group, an alkoxy group, an aryloxy group, a cyano group, an alkylsulfonyl group, an arylsulfonyl group, a ureido group, an alkylthio group, an arylthio group, a carboxyl group, a sulfo group or a heterocyclic residual group, provided that each of these may have a substituent.

11. A thermally developable light-sensitive material according to claim 1 wherein said dye-providing material is a polymer.

12. A thermally developable light-sensitive material according to claim 1 wherein said binder is gelatin or its derivative combined with a synthetic hydrophilic polymer.

13. A thermally developable light-sensitive material according to claim 1 wherein said binder is used in an amount within the range of from 0.1 to 10 g per square meter of the support.

14. A thermally developable light-sensitive material according to claim 1 which further contains a thermal solvent.

15. A thermally developable light-sensitive material according to claim 1 which further contains an organic silver salt.

16. A thermally developable light-sensitive material according to claim 15 wherein said organic silver salt is a silver salt of a benzotriazole derivative.

17. A thermally developable light-sensitive material having at least a light-sensitive silver halide, a reducing agent, a binder and a dye-providing material on a support, said dye-providing material being a compound which has a group capable of substitution or addition reaction with a nucleophilic agent wherein said reducing agent is an N-(p-N,N-dialkylphenyl)sulfamic acid salt.

18. A thermally developable light-sensitive material according to claim 17 wherein said dye-providing material is at least partially substitution or addition reacted with said nucleophilic agent.

19. A thermally developable light-sensitive material having at least a light-sensitive silver halide, a reducing agent, a binder and a dye-providing material on a support, said dye-providing material being a compound which has a group capable of substitution or addition reaction with a nucleophilic agent wherein said nucleophilic agent is a low molecular compound which has at least two groups selected from amino, hydroxy and mercapto groups, said dye-providing material being at least partially substitution or addition reacted with said nucleophilic agent.

* * * * *